US007213686B2

(12) United States Patent
Kaufman

(10) Patent No.: US 7,213,686 B2
(45) Date of Patent: May 8, 2007

(54) SCISSOR LIFT MECHANISM

(75) Inventor: Michael Kaufman, Rahden (DE)

(73) Assignee: Pro Hub Hebetechnik GmbH, Diepenau (DE)

( * ) Notice: Subject to any disclaimer, the term of this patent is extended or adjusted under 35 U.S.C. 154(b) by 314 days.

(21) Appl. No.: 10/792,283

(22) Filed: Mar. 4, 2004

(65) Prior Publication Data

US 2004/0251453 A1 Dec. 16, 2004

(30) Foreign Application Priority Data

Mar. 4, 2003 (EP) ..... 03004756

(51) Int. Cl.
*B66B 11/06* (2006.01)
*B66F 7/06* (2006.01)

(52) U.S. Cl. ..... 187/262; 211/269; 254/122; 254/9 C

(58) Field of Classification Search ..... 187/211, 187/262, 269; 254/9 C, 122
See application file for complete search history.

(56) References Cited

U.S. PATENT DOCUMENTS 3,785,462 A * 1/1974 Coad et al. ..... 187/262
4,534,544 A * 8/1985 Heide ..... 254/9 C
4,858,888 A * 8/1989 Cruz et al. ..... 254/122
4,984,774 A * 1/1991 Zupancic et al. ..... 5/601
6,516,478 B2 * 2/2003 Cook et al. ..... 5/611
6,705,238 B1 * 3/2004 Heckert ..... 108/145
2003/0047388 A1 * 3/2003 Faitel ..... 187/214

FOREIGN PATENT DOCUMENTS

DE 35 02 641 A1 7/1986
DE 9108825 U1 1/1992
DE 29803330 U1 6/1998
DE 100 24 075 A1 11/2001
DE 10024075 A1 * 11/2001
EP 501254 A2 * 9/1992
WO 99/62813 12/1999

* cited by examiner

*Primary Examiner*—Gene C. Crawford
*Assistant Examiner*—Terrell Matthews
(74) *Attorney, Agent, or Firm*—Crowell & Moring LLP

(57) ABSTRACT

A scissor lift mechanism (1) having at least two scissor elements (4, 5) connected in pairs by a swivel axis (3). The drive (11) for raising and lowering the scissor elements (4, 5) is provided by a traction member (13). To reduce the driving power required for operation while at the same time reducing control complexity, the scissor lift mechanism (1) is equipped with two coupling bridges (14, 15) situated on opposite sides of the swivel axis (3) and pivotably supported by thrust struts (22, 23) on each of the two scissor elements (4, 5), respectively. The distance "a" between the coupling bridges (14, 15) and the resulting height of lift "h" are easily variable by applying a tractive force "F" via the traction member (13, 25) which is guided around reversing rollers (16) and back and forth along a plurality of generally parallel paths (18, 19, 20, 21) between the two coupling bridges (14, 15).

14 Claims, 3 Drawing Sheets

SCISSOR LIFT MECHANISM

BACKGROUND OF THE INVENTION

This invention relates to a scissor lift mechanism having at least two scissor elements connected in pairs by a swivel axis, so that the swivel axis is arranged between the respective end sections of the scissor elements; and having a drive for raising and lowering the scissor elements by a traction member.

A scissor lift mechanism of this type is described, for example, in published German Patent application no. DE 100 24 075 A1. Through the traction member, the distance between the upper and lower ends of the scissor elements is varied. The traction member is therefore connected to one end of one scissor element and to the drive via a pulley on an upper end of the other scissor element and therefore it can be drawn in. In this case, the traction member acts on an expansion body which in the lowered resting position of the scissor lift mechanism is situated close to the lower end of a scissor element between it and the upper end of the other scissor element resting thereon. By applying the required tractive force, the expansion body is moved in the direction of the swivel axis. The angle formed by the scissor elements thereby becomes progressively larger so that the height of lift is varied accordingly. This traction member is not reeled up by this drive but instead it has an end section that is closed to form a loop to thereby prevent the traction member from slipping off.

It has proven to be a disadvantage with such scissor lift mechanisms that their height of lift is varied by an expansion body; that the lever ratios in the lowered resting position vary greatly from those in the raised working position. The forces required to change the height of lift therefore differ many-fold in the two extreme positions. In practice, this results in wear phenomena. In addition, a high driving power is therefore necessary. In addition, the movement of the expansion body must be adjusted using a complex control system, so the rate of lifting between the extreme positions is approximately constant but at least is not subject to any great fluctuations.

Another embodiment of a scissor lift mechanism is known from U.S. Pat. No. 4,534,544 (=DE 33 31 872 A1) in which the two end sections of the scissor elements are joined by a drive constructed as a hydraulic cylinder. However, this means a large opening path of the hydraulic cylinder, so that here again, the forces required to be applied may vary greatly. Furthermore, hydraulic cylinders have only a limited suitability in many practical applications because of the oil they release.

German Utility Model DE 298 03 330 U discloses a scissor lift mechanism which ensures that relatively high lifting forces can be generated with comparatively low driving forces even in the initial phase of the lifting operation due to favorable lever ratios. However, it is a disadvantage here that this results in two speed levels in the lifting and lowering operations and that a jerky change in speed occurs when the expansion body is gripped by a supporting swivel arm. In this case, the expansion body acts only according to the wedge principle on the upper and lower scissor-type elements before the intervention of the swivel arm, so that the upward movement proceeds very slowly. As soon as the expansion body has been raised by the supporting swivel arm, the result is an operative connection to only the upper scissor halves where the transport movement is accelerated suddenly. Precise positioning is therefore no longer possible in the transition area.

U.S. Pat. No. 4,858,888 also discloses a scissor lift mechanism in which the free end of the supporting arm is guided by a guide arm that is bent at an angle and is also attached to the first scissor element via an articulated connection.

Additional scissor lift mechanisms are known from WO 99/62813, DE 91 08 825 U, DE 35 02 641 A and U.S. Pat. No. 3,785,462.

SUMMARY OF THE INVENTION

Accordingly, it is an object of the invention to provide an improved scissor-type lift mechanism.

Another object of the invention is to provide a scissor-type lift mechanism in which the driving power required during operation is significantly reduced.

A further object of the invention is to provide a scissor lift mechanism with minimal complexity which is suitable for a variety of applications.

These and other objects are achieved in accordance with the present invention by providing a scissor lift mechanism comprising at least two scissor elements connected in pairs at a swivel axis situated between end sections of the scissor elements, a drive for raising or lowering the scissor elements via a traction member attached to the scissor lift mechanism, and at least one coupling bridge with two swivelable thrust struts each connected to a respective scissor element by a pivotable connection, wherein the coupling bridge carries at least one reversing roller for the traction member.

Further advantageous embodiments of the invention are described in more detail hereinafter.

Thus, according to this invention, the scissor lift mechanism has at least one coupling bridge with two thrust struts arranged so they are pivotable by a joint and are each pivotably connected to one scissor element, whereby the coupling bridge carries a pulley for the traction member attached to the scissor lift mechanism. Thus, for the first time, it is possible in this way for the lifting force to be introduced not through the spreading action of an expansion body, but instead through the adjustment of the distance between the coupling bridge connected to both scissor elements and the scissor lift mechanism, e.g., the pivot axis to which the free end of the traction member is attached. The coupling bridge is therefore equipped with a pulley so that by applying the tractive force, the distance and thus at the same time the height of lift are altered with little effort. Because of the favorable lever ratios thereby implementable, the peak load to be applied by the drive, in particular when raising [an object] out of the lower resting position, is greatly reduced. This also results in much less wear because the deflection of the traction member is subject to only very minor friction losses. In addition, it is found that because of the altered introduction of forces, an almost constant ratio between the differential length of the traction member and the difference in the height of lift is achievable, so this greatly reduces the complexity of the control required. In addition, the scissor lift mechanism allows a simple adjustment to different use conditions in that only the traction member must be replaced when there are greater load requirements. Thus complicated new constructions can be avoided in many cases.

The free end of the traction member may be secured on the swivel axis. However, an embodiment of the present invention having especially great practical relevance is also achieved by a scissor lift mechanism having one coupling bridge on each side of the swivel axis, the first coupling bridge being equipped with at least one pulley and the second coupling bridge being equipped with an attachment for the traction member. This achieves a much more uniform introduction of force into the scissor elements through the two opposing coupling bridges by the particular thrust struts and thus operating reliability is increased while at the same time the load on individual thrust struts is reduced.

An especially advantageous embodiment is achieved by having the swivel axis and the coupled bridges arranged in a common plane, especially a horizontal plane. This yields a uniform lifting motion and at the same time reduces variations in the required driving power between extreme positions of the scissor lift mechanism.

Increased load requirements could be met by a modified drive power. However, an especially simple modification of the present invention is one in which the traction member is guided back and forth repeatedly in several paths between the two coupling bridges via a plurality of pulleys mounted on the two coupling bridges. This makes it possible to reduce the required tractive force and consequently the drive power with each additional path, i.e., to increase the maximum lifting power of the scissor lift mechanism. At the same time, the tractive force acting on the traction member is reduced. The lift capacity can therefore also be changed to adapt it to the particular conditions of use with little effort or expense even in preexisting scissor lift mechanisms.

The paths which are guided in parallel to one another in particular could be situated side-by-side in a common horizontal plane, in particular a plane determined by the swivel axis. However, it is especially advantageous if the paths of the traction member are arranged one above the other. This causes the deflection of the traction member to take place exclusively in one plane even when the drive for the traction member is located outside the scissor lift mechanism in a stationary mount. The resulting load acting on the traction member as well as the wear phenomena that occur are thus greatly reduced.

In one particularly advantageous embodiment of the scissor lift mechanism according to the invention, the thrust struts are spaced equally between the coupling bridge and the respective scissor element with which they are associated. Accordingly, the orientation of the coupling bridges, like the principle of the parallelogram guide, remains unaffected by the position in space, which depends on the height of lift. The path guidance of the traction member is therefore constant over the entire height of lift.

In an additional refinement of this invention which also promises particular success, a plurality of traction member arranged parallel to one another are wrapped in opposite directions around the pulleys. Consequently, the torques introduced because of the traction member guided in a plurality of paths mutually cancel out one another due to the opposing arrangement of adjacent paths. The traction member guided in parallel may then be guided on a shared pulley as well as on individual pulleys, especially those arranged coaxially.

The traction member may be constructed, for example, as a plastic or wire cable, as a chain, as a V-belt, or as a toothed belt. However, an embodiment in which the traction member is designed as a flat belt in at least some sections has proved particularly practical. The flat belt combines a high flexibility and traction load-bearing capacity and also does not require any lubricant. Furthermore a flat belt can be used without generating disturbing operating noises and permits a low overall structural height.

An embodiment of this invention which is particularly versatile in use is also achieved if the scissor lift mechanism is expanded in a modular fashion by additional scissor elements arranged in pairs. Double or tandem designs can thus be constructed with little complexity and can be operated by a single joint traction member. This consequently eliminates any need for a complex control system as has been required in the prior art in order to achieve a synchronous motion sequence. In accordance with another advantageous embodiment, if multiple traction member are used, they may, in particular, be operable by a common drive.

In yet another highly advantageous embodiment of the present invention, the two coupling bridges are connected together by a guide element, the length of which is continuously variable in order to adjust to different heights of lifts. This guide element, designed to be telescoping in particular, limits the relative mobility of the two coupling bridges in relation to one another to only one degree of freedom so that only the distance between the two coupling bridges is variable. Thus, the orientation of the coupling bridges remains constant.

It is particularly advantageous in this case if the guide element is constructed or designed as a damper or as an emergency brake in order to prevent any unintentional lowering of the lift mechanism when there is a sudden release of tension. In ordinary operation, use of a guide element which is equipped with a hydraulic cylinder, for example, makes possible a damping effect when the load changes.

The drive may be arranged in a fixed location spatially separate from the scissor lift mechanism. However, an especially compact embodiment can be achieved if the drive is mounted on the coupling bridge in a plane defined by the joint of the thrust struts and the swivel axis. Several drives may be provided arranged opposite each other so that one is associated with each coupling bridge.

In addition, an embodiment of the inventive scissor lift mechanism which is especially promising is achieved when the drive is connected to a winding drum for the traction member, the winding diameter, which is determined in particular by the number of windings, being determined as a function of the material thickness of the traction member so that a constant rotational speed of the winding drum leads to a constant change in the height of lift of the scissor lift mechanism to thereby achieve a uniform lifting motion without any rotational speed control.

BRIEF DESCRIPTION OF THE DRAWINGS

The invention will be described in further detail hereinafter with reference to illustrative preferred embodiments shown in the accompanying drawing figures in which.

DETAILED DESCRIPTION OF PREFERRED EMBODIMENTS

Figures 1, 2:
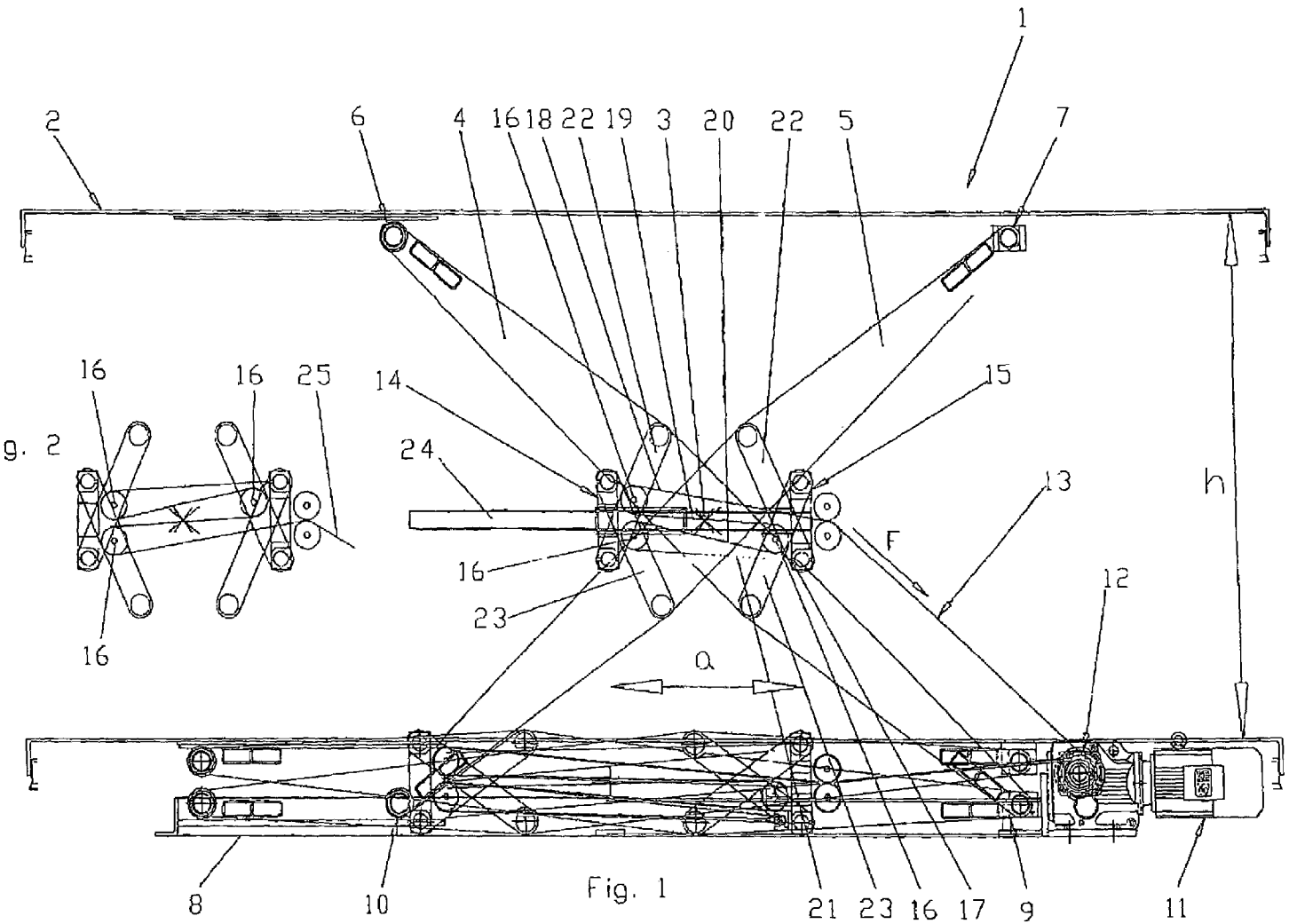
FIG. 1 shows a side view of a scissor lift mechanism according to the present invention.
FIG. 2 shows a detail view of the scissor lift mechanism of FIG. 1.

FIG. 1 shows a side view of a scissor lift mechanism 1 according to the invention. The scissor lift mechanism 1 has two scissor elements 4, 5 which are located beneath a lifting surface 2 and are connected in pairs by a swivel axis 3, whereby swivel axis 3 is arranged in the middle between the end sections 6, 7 of the scissor elements 4, 5 supporting the lifting plane 2 on the one hand and end sections 9, 10 which rest on a base surface 8 on the other hand. The scissor lift mechanism 1 is further equipped with a drive 11 in a stationary mount on the base surface 8. A traction member 13 in the of form a preferably flat belt for raising and lowering the scissor 4, 5 is provided on the winding drum 12 of the drive 11. To this end the scissor lift mechanism 1 is equipped with two parallel coupling bridges 14, 15 arranged on both sides of the swivel axis 3, the first coupling bridge 14 being equipped with at least two reversing rollers or pulleys 16 and the second coupling bridge 15 being equipped with one reversing roller 16 and one mounting point or attachment 17 for the traction member 13 so that the traction member 13 is guided in a plurality of paths or tracks 18, 19, 20, 21, one above the other. The two coupling bridges 14, 15 are each pivotably supported on the scissor elements 4, 5 via two identically constructed thrust struts 22, 23. The distance "a" between the coupling bridges 14, 15 is variable by the application of a tractive force "F" by the traction member 13 so that the height of lift "h" can be achieved in the desired manner. In addition, the coupling bridges 14, 15 are connected by a guide element 24 which acts as a damping element and is constructed in particular in the form of a hydraulic cylinder so that changes in load do not result in undesirably high peak stresses.

In addition, in a detailed view of the scissor lift mechanism 1 shown in FIG. 1, FIG. 2 shows another traction member 25 which is guided in a plane parallel to the plane of the drawing and which is operated by the shared drive 11. In contrast with the course of the paths 18, 19, 20, 21 of the traction member 13 shown in FIG. 1, the additional traction member 25 is wrapped around the reversing rollers 16 in the opposite direction. In this way torques introduced through the tractive force F of the traction member 13, 25 mutually offset one another.

Figure 3:
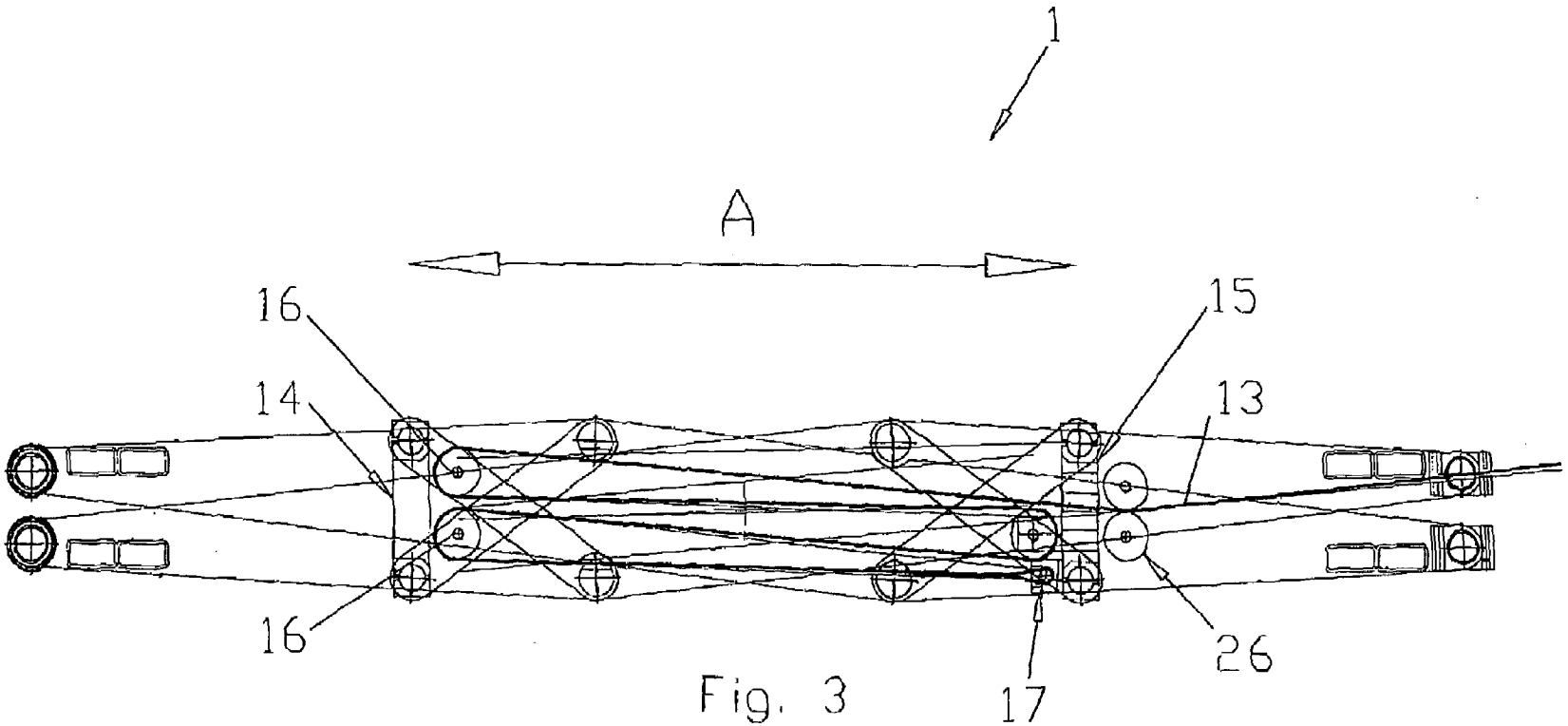
FIG. 3 shows an enlarged detail view of the scissor lift mechanism of FIG. 1 in a lowered position.

FIG. 3 shows an enlarged detailed view of the scissor lift mechanism 1 shown in FIG. 1, shown here in a lowered position in which the coupling bridges 14, 15 are a distance "A" apart. In this embodiment the traction member 13 is guided by a pair 26 of guide rollers mounted on the second coupling bridge 15. By reversing the direction of the traction member 13 around two guide rollers 16 on the first coupling bridge 14 and one reversing roller 16 on the second coupling bridge 15 as well as the attachment 17 of the traction member 13 to the second coupling bridge 15, the transmitted force is multiplied so that even large lifting forces can be attained with comparatively little expenditure of effort. At the same time the required tractive forces in the lower position illustrated here deviate only slightly from the operating position shown in FIG. 1 so that a uniform lifting motion is achieved with a constant pulling motion of the traction member 13.

Figure 4:
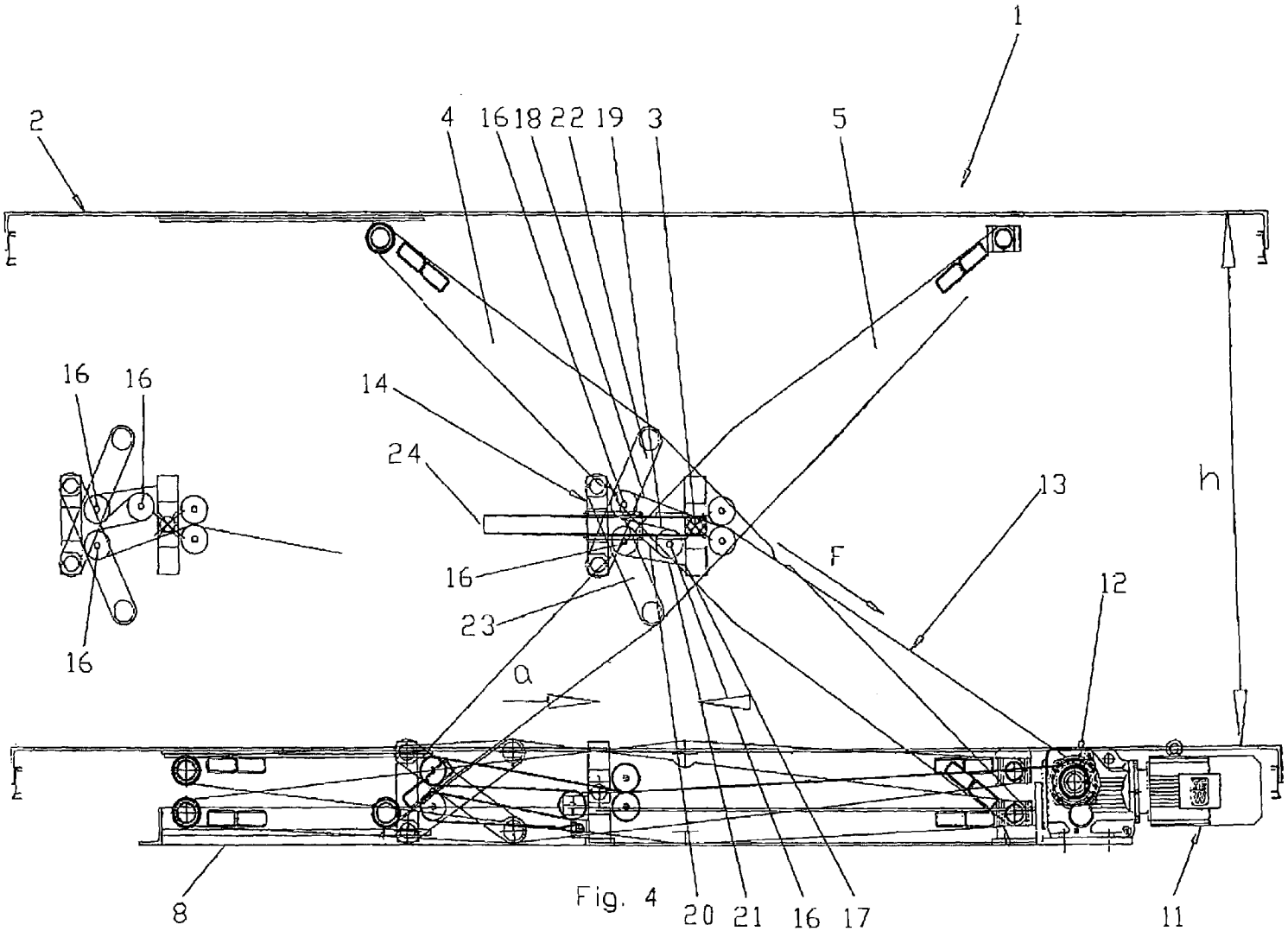
FIG. 4 shows a modified embodiment of the scissor lift mechanism shown in FIG. 1.

FIG. 4 shows a modified form of the scissor lift mechanism 1 of the invention with two scissor elements 4, 5 connected by the swivel axis 3 beneath the lifting surface 2, having a drive 11 in a stationary mount on the base surface 8 and traction member 13 for raising and lowering the scissor elements 4, 5 attached to the winding drum 12 of the drive 11. In this embodiment the scissor type lift mechanism 1 has only a single coupling bridge 14 which is positioned on one side of the swivel axis 3 and carries a plurality of reversing rollers 16. The attachment 17 for the traction member 13 in this device is connected to the swivel axis 3 in a common vertical plane so that the traction member 13 is guided along a plurality of tracks or paths 18, 19, 20, 21, arranged one above the other. The coupling bridge 14 is pivotably supported on the scissor elements 4, 5 by two identically contructed thrust struts 22, 23. Due to the application of a tractive force "F" by the traction member 13, the distance "a" between the coupling bridge 14 and the swivel axis 3 is variable so that the height of lift "h" can be adjusted in the desired manner. In order to stabilize the coupling bridge 14, the bridge is connected to the swivel axis 3 by the guide element 24, thus ensuring an essentially vertical alignment of the coupling bridge 14 at different heights of lift "h".

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A scissor lift mechanism comprising at least two scissor elements connected in pairs at a swivel axis situated between end sections of the scissor elements, a drive for raising or lowering the scissor elements via a traction member attached to the scissor lift mechanism, and at least two coupling bridges arranged on opposite sides of the swivel axis with each coupling bridge having two swivelable thrust struts each connected to a respective scissor element by a pivotable connection, wherein one of the coupling bridges carries at least one reversing roller for the traction member, and the traction member is attached to the other of said coupling bridges.

2. A scissor lift mechanism according to claim 1, wherein the swivel axis and the coupling bridges are arranged in a common plane.

3. A scissor lift mechanism according to claim 2, wherein said common plane is a horizontal plane.

4. A scissor lift mechanism according to claim 1, wherein the traction member is guided back and forth along a plurality of generally parallel paths between the two coupling bridges by a plurality of reversing rollers arranged on the two coupling bridges.

5. A scissor lift mechanism according to claim 4, wherein the generally parallel paths of the traction member are arranged one above another.

6. A scissor lift mechanism according to claim 1, wherein the thrust struts define equal spacings between between the coupling bridge and the respective scissor elements to which the thrust struts are attached.

7. A scissor lift mechanism according to claim 1, wherein a plurality of traction member arranged generally parallel to one another are wrapped around the reversing rollers in opposite directions.

8. A scissor lift mechanism according to claim 1, wherein at least a portion of the traction member is in the form of a flat belt.

9. A scissor lift mechanism according to claim 1, wherein the lift mechanism comprises a plurality of pairs of scissor elements arranged in a modular fashion.

10. A scissor lift mechanism according to claim 1, wherein the lift mechanism comprises a plurality of traction member operated by a common drive.

11. A scissor lift mechanism according to claim 1, wherein the two coupling bridges are interconnected by a guide element which is continuously adjustable in length.

12. A scissor lift mechanism according to claim 11, wherein said guide element is constructed as a damping element or an emergency brake.

13. A scissor lift mechanism according to claim 1, wherein the drive is disposed on the coupling bridge.

14. A scissor lift mechanism according to claim 1, wherein the drive is connected to a winding drum for the traction member, and the winding diameter of the drum is determined as a function of the thickness of the traction member such that a constant rotational speed of the winding drum leads to a substantially constant change in lift height of the lift mechanism.

* * * * *